US008569959B2

(12) United States Patent
Hsieh

(10) Patent No.: US 8,569,959 B2
(45) Date of Patent: Oct. 29, 2013

(54) LAMP CONTROL CIRCUIT

(75) Inventor: Ming-Chih Hsieh, Tu-Cheng (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 364 days.

(21) Appl. No.: 12/949,830

(22) Filed: Nov. 19, 2010

(65) Prior Publication Data

US 2012/0104973 A1 May 3, 2012

(30) Foreign Application Priority Data

Oct. 29, 2010 (TW) ..... 099137120

(51) Int. Cl.
*H05B 37/02* (2006.01)

(52) U.S. Cl.
USPC .... 315/185 R; 315/186; 315/193; 315/209 R; 315/210; 315/291; 315/294; 315/299; 315/362

(58) Field of Classification Search
USPC ..... 326/104; 315/312, 76, 210, 185 R
See application file for complete search history.

(56) References Cited

U.S. PATENT DOCUMENTS 3,450,897 A * 6/1969 Henn ..... 377/126
3,488,558 A * 1/1970 Grafton ..... 315/312
3,531,765 A * 9/1970 Christianson et al. ..... 340/953
3,944,878 A * 3/1976 Gerontakis ..... 315/316
4,215,277 A * 7/1980 Weiner et al. ..... 307/41
5,894,201 A * 4/1999 Wong ..... 315/241 S
5,969,479 A * 10/1999 Wong ..... 315/200 A
7,494,237 B1 * 2/2009 Cheung ..... 362/103
8,169,163 B2 * 5/2012 Kang et al. ..... 315/312
2007/0120506 A1 * 5/2007 Grant ..... 315/312
2009/0195168 A1 * 8/2009 Greenfeld ..... 315/192

OTHER PUBLICATIONS

Marasco, Ken; 'How to Apply Low-Dropout Regulators Successfully', Analog Dialogue 43-08 Back Burner, Aug. 2009.*
Williams, Jim; 'High Efficiency Linear Regulators', Linear Technology Application Note 32, Mar. 1989.*
'FET Applications'; Electronic Circuits and Diagram-Electronics Projects and Design, Aug. 30, 2009.*

* cited by examiner

*Primary Examiner* — Daniel Cavallari
*Assistant Examiner* — Christine Johnson
(74) *Attorney, Agent, or Firm* — Altis & Wispro Law Group, Inc.

(57) ABSTRACT

A lamp control circuit includes a first switch circuit receiving a voltage from a power supply after a control is turned on and outputs a first control signal, a count circuit receives the first control signal and outputs a second control signal, a gate circuit receives the second control signal and outputs a third control signal, a second switch circuit includes a number of electronic switches to receive the third control signal and controls the electronic switches to be turned on or turned off, and a lighting circuit including a number of light emitting diode (LED) groups. Each LED group includes an LED. When an electronic switch connected to an LED group is turned on, the LED of the corresponding LED group is lit. When an electronic switch connected to an LED group is turned off, the LED of the LED group does not light.

11 Claims, 1 Drawing Sheet

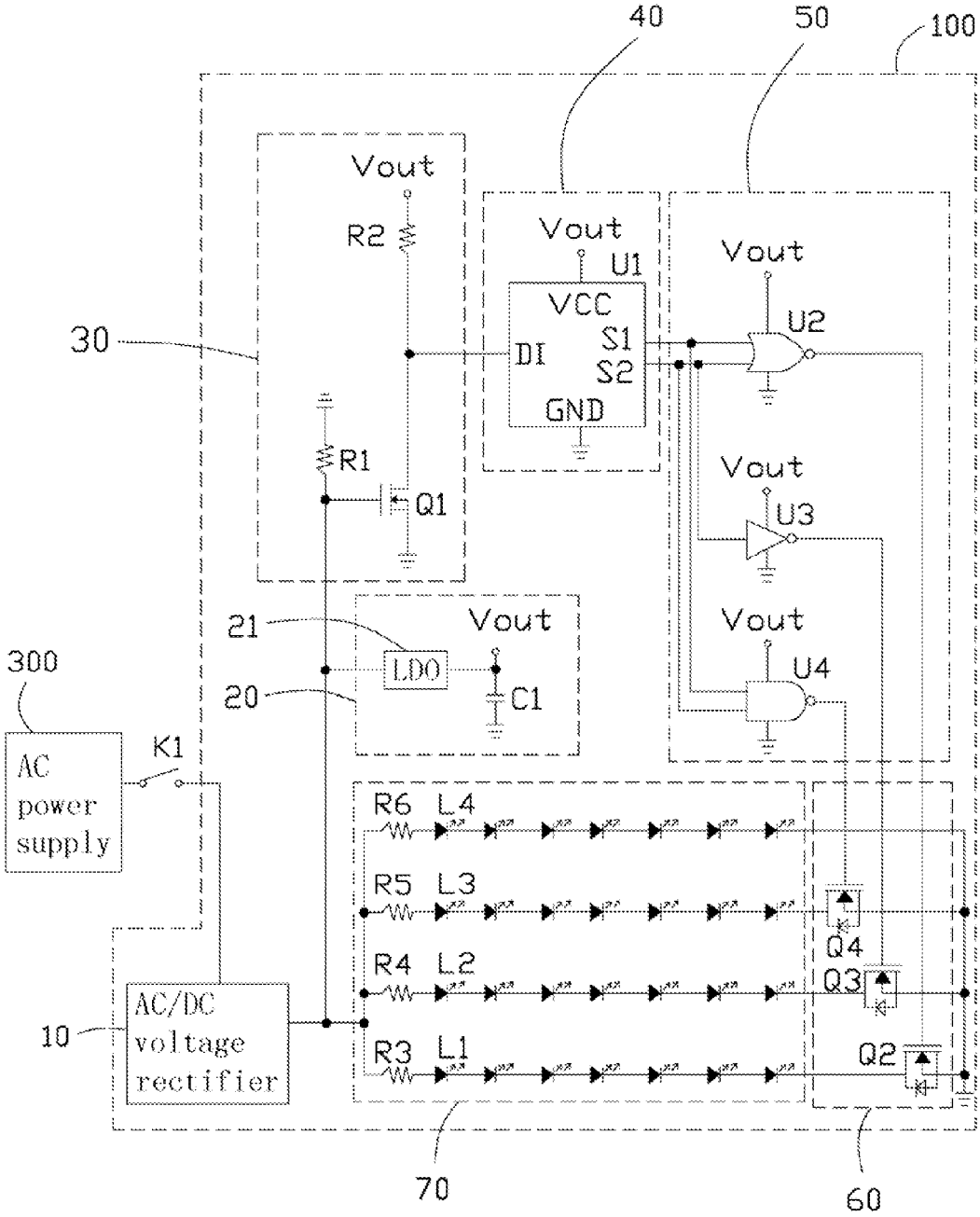
40
50
100
Vout
R2
Vout
U1
VCC
S1
S2
DI
GND
Vout
U2
30
R1
Q1
Vout
U3
21
Vout
LDO
C1
Vout
U4
300
20
K1
AC
power
supply
R6 L4
R5 L3
R4 L2
R3 L1
Q4
Q3
Q2
10
AC/DC
voltage
rectifier
70
60

LAMP CONTROL CIRCUIT

BACKGROUND

1. Field of the Invention

The present disclosure relates to control circuits, and particularly to a lamp control circuit.

2. Description of Related Art

Many lamps provide only a single brightness level, and thereby cannot satisfy different user requirements. Therefore, there is room for improvement in the art.

BRIEF DESCRIPTION OF THE DRAWING

Many aspects of the embodiments can be better understood with reference to the following drawing. The components in the drawing are not necessarily drawn to scale, the emphasis instead being placed upon clearly illustrating the principles of the present embodiments. Moreover, in the drawing, like reference numerals designate corresponding parts throughout the several views.

The drawing is a schematic diagram of a lamp control circuit in accordance with an exemplary embodiment of the present disclosure.

DETAILED DESCRIPTION

The disclosure, including the drawings, is illustrated by way of example and not by limitation. It should be noted that references to "an" or "one" embodiment in this disclosure are not necessarily to the same embodiment, and such references mean at least one.

Referring to the drawing, a lamp control circuit 100 is connected to an alternating current (AC) power supply 300 through a control K1. The lamp control circuit 100 in accordance with an exemplary embodiment includes an alternating current to direct current (AC/DC) voltage rectifier 10, a voltage regulating circuit 20, a first switch circuit 30, a count circuit 40, a gate circuit 50, a second switch circuit 60, and a lighting circuit 70. The gate circuit 50 includes a plurality of gate elements, such as three gate elements. The second switch circuit 60 includes a plurality of electronic switches, such as three electronic switches. The lighting circuit 70 includes a plurality of light emitting diode (LED) groups, such as four LED groups. In one embodiment, each LED group includes seven LEDs.

The voltage regulating circuit 20 includes a low dropout regulator (LDO) 21, a capacitor C1, and a voltage terminal Vout. An input terminal of the LDO 21 is connected to an output terminal of the AC/DC voltage rectifier 10. An input terminal of the AC/DC voltage rectifier 10 is connected to the AC power supply 300 through the control K1. An output terminal of the LDO 21 is connected to a voltage terminal Vout and also grounded through the capacitor C1. In one embodiment, the capacitor C1 is a super-capacitor.

The first switch circuit 30 includes an electronic switch, such as an n-channel field effect transistor (FET) Q1 and two resistors R1 and R2. A gate of the FET Q1 is connected to the output terminal of the AC/DC voltage rectifier 10 and also grounded through the resistor R1. A source of the FET Q1 is grounded. A drain of the FET Q1 is connected to the count circuit 40 and also connected to the voltage terminal Vout through the resistor R2.

The count circuit 40 includes a counter U1. An input terminal DI of the counter U1 is connected to the drain of the FET Q1. A voltage terminal VCC of the counter U1 is connected to the voltage terminal Vout. A ground terminal GND of the counter U1 is grounded. Output terminals S1 and S2 of the counter U1 are connected to the gate circuit 50.

The gate circuit 50 includes a NOR gate U2, a NOT gate U3, and a NAND gate U4. Two input terminals of the NOR gate U2 are respectively connected to the output terminals S1 and S2 of the counter U1. An input terminal of the NOT gate U3 is connected to the output terminal S2 of the counter U1. Two input terminals of the NAND gate U4 are respectively connected to the output terminals S1 and S2 of the counter U1. Voltage terminals of the NOR gate U2, the NOT gate U3, and the NAND gate U4 are connected to the voltage terminal Vout. Ground terminals of the NOR gate U2, the NOT gate U3, and the NAND gate U4 are grounded. Output terminals of the NOR gate U2, the NOT gate U3, and the NAND gate U4 are connected to the second switch circuit 60.

The second switch circuit 60 includes three electronic switches, such as n-channel FETs Q2-Q4. A gate of the FET Q2 is connected to the output terminal of the NOR gate U2. A gate of the FET Q3 is connected to the output terminal of the NOT gate U3. A gate of the FET Q4 is connected to the output terminal of the NAND gate U4. Sources of the FETs Q2-Q4 are grounded. Drains of the FETs Q2-Q4 are connected to the lighting circuit 70.

The lighting circuit 70 includes first to fourth LED groups and four resistors R3-R6. The first LED group includes seven LEDs L1 connected in series. The second LED group includes seven LEDs L2 connected in series. The third LED group includes seven LEDs L3 connected in series. The fourth LED group includes seven LEDs L4 connected in series. The resistor R3 is connected between the output terminal of the AC/DC voltage rectifier 10 and a positive terminal of the first LED group, and a negative terminal of the first LED group is connected to the drain of the FET Q2. The resistor R4 is connected between the output terminal of the AC/DC voltage rectifier 10 and a positive terminal of the second LED group, and a negative terminal of the second LED group is connected to the drain of the FET Q3. The resistor R5 is connected between the output terminal of the AC/DC voltage rectifier 10 and a positive terminal of the third LED group, and a negative terminal of the third LED group is connected to the drain of the FET Q4. The resistor R6 is connected between the output terminal of the AC/DC voltage rectifier 10 and a positive terminal of the fourth LED group, and a negative terminal of the fourth LED group is grounded. In other embodiments, a number of the LEDs can be changed according to need. The voltage regulating circuit 20 can be omitted to save cost.

In use, when the control K1 is turned on, the AC/DC voltage rectifier 10 receives AC voltage from the AC power supply 300 and converts the received AC voltage to DC voltage. The LDO 21 receives the DC voltage from the AC/DC voltage rectifier 10 and outputs a regulating voltage to the first switch circuit 30, the counter U1, the NOR gate U2, the NOT gate U3, and the NAND gate U4 through the voltage terminal Vout. The gate of FET Q1 also receives the DC voltage from the AC/DC voltage rectifier and FET Q1 is turned on. The drain of the FET Q1 outputs a low level signal to the input terminal DI of the counter U1. The counter U1 receives the low level signal and initiates a counting sequence, the output terminals S1 and S2 of the counter U1 output low level signals or high level signals, in binary, "0" stands for a low level signal, and "1" stands for a high level signal, thereby the output terminals S1 and S2 together output signals "00", "01", "10", or "11".

When the control K1 is turned on a first time, the output terminals S1 and S2 of the counter U1 output signals "00". The output terminals of the NOR gate U2, the NOT gate U3, and the NAND gate U4 respectively output high level signals "111". The FETs Q2-Q4 are turned on. The drains of the FETs Q2-Q4 are pulled down. At the same time, the first to the fourth LED groups L1-L4 are lit.

When the control K1 is turned off and then turned on a second time, the output terminals S1 and S2 of the counter U1 output signals "01". The output terminals of the NOR gate U2, the NOT gate U3, and the NAND gate U4 output signals "001". The FETs Q2 and Q3 are turned off, and the FET Q4 is turned on. The drain of the FET Q4 is pulled down. At the same time, the third and the fourth LED groups L3 and L4 are lit, and the first and the second LED groups L1 and L2 do not light.

When the control K1 is turned off and turned on a third time, the output terminals S1 and S2 of the counter U1 output signals "10". The output terminals of the NOR gate U2, the NOT gate U3, and the NAND gate U4 output signals "011". The FET Q2 is turned off, and the FETs Q3 and Q4 are turned on. The drains of the FETs Q3 and Q4 are pulled down. At the same time, the first LED group L1 does not light, and the second to the fourth LED groups L2 and L4 are lit.

When the control K1 is turned off and turned on a fourth time, the output terminals S1 and S2 of the counter U1 output signals "11". The output terminals of the NOR gate U2, the NOT gate U3, and the NAND gate U4 output signals "000". The FETs Q2-Q4 are turned off. At the same time, the first to the third LED groups L1-L3 do not light, and the fourth LED group L4 is lit.

The lamp control circuit 100 selectively lights the first to fourth LED groups L1-L4 through the control K1, to provide different brightness levels.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A lamp control circuit connected to a power supply through a control, the lamp control circuit comprising:

a first switch circuit to receive a voltage from the power supply when the control is turned on and output a first control signal;

a count circuit to receive the first control signal from the first switch circuit and output a second control signal;

a gate circuit to receive the second control signal from the count circuit and output a third control signal;

a second switch circuit comprising first to third electronic switches, to receive the third control signal from the gate circuit, thereby the first to third electronic switches being turned on or turned of according to the third control signal; and a lighting circuit comprising first to fourth light emitting diode (LED) groups, the first to third LED groups respectively connected to the first to third electronic switches, each LED group comprising at least one LED, wherein turning on or off the first to third electronic switches controls the turning on or off of the corresponding LED groups, wherein when the control is turned on a first time, the first to third electronic switches are turned on, the first to fourth LED groups are lit; when the control is turned off and then turned on a second time, the first and second electronic switches are turned off, and the third electronic switch is turned on, the third and the fourth LED groups are lit, and the first and the second LED groups do not light; when the control is turned off and turned on a third time, the first electronic switch is turned off, the second and third are turned on, the first LED group does not light, and the second to the fourth LED groups are lit; when the control is turned off and turned on a fourth time, the first to third electronic switches are turned off, the first to the third LED groups do not light, the fourth LED group is lit.

2. The lamp control circuit as claimed in claim 1, wherein the lamp control circuit further comprises an alternating current to direct current (AC/DC) voltage rectifier, the AC/DC voltage rectifier receives alternating current (AC) voltage from an AC power supply after the control is turned on, and converts the received AC voltage to direct current (DC) voltage and provides the voltage to the lamp control circuit.

3. The lamp control circuit as claimed in claim 2, further comprising a voltage regulating circuit, to receive the DC voltage from the AC/DC voltage rectifier and output a regulating voltage to the first switch circuit, the count circuit, and the gate circuit.

4. The lamp control circuit as claimed in claim 3, wherein the voltage regulating circuit comprises a low dropout regulator (LDO), a capacitor, and a voltage terminal, an input terminal of the LDO is connected to an output terminal of the AC/DC voltage rectifier to receive the DC voltage, an output terminal of the LDO is connected to the voltage terminal and grounded through the capacitor.

5. The lamp control circuit as claimed in claim 4, wherein the first switch circuit comprises a fourth electronic switch, a first resistor, and a second resistor, a first terminal of the fourth electronic switch is connected to the output terminal of the AC/DC voltage rectifier and grounded through the first resistor, a second terminal of the fourth electronic switch is connected to the count circuit and connected to the voltage terminal through the second resistor, a third terminal of the fourth electronic switch is grounded.

6. The lamp control circuit as claimed in claim 5, wherein the fourth electronic switch is an n-channel field effect transistor, the first to third terminals of the electronic switch are a gate, a drain, and a source of the n-channel field effect transistor.

7. The lamp control circuit as claimed in claim 5, wherein the count circuit comprises a counter, an input terminal of the counter is connected to the second terminal of the fourth electronic switch, a voltage terminal of the counter is connected to the voltage terminal, a ground terminal of the counter is grounded, first and second output terminals of the counter are connected to the gate circuit.

8. The lamp control circuit as claimed in claim 7, wherein the gate circuit comprises a NOR gate, a NOT gate, and a NAND gate, two input terminal of the NOR gate are respectively connected to the first and second output terminals of the counter, an input terminal of the NOT gate is connected to the second output terminal of the counter, two input terminals of the NAND are respectively connected to the first and second output terminals of the counter, voltage terminals of the NOR gate, the NOT gate, and the NAND gate are connected to the voltage terminal of the voltage regulating circuit, ground terminals of the NOR gate, the NOT gate, and the NAND gate are grounded, output terminals of the NOR gate, the NOT gate, and the NAND gate are connected to the second switch circuit.

9. The lamp control circuit as claimed in claim 8, wherein a first terminal of the first electronic switch is connected to the output terminal of the NOR gate, a first terminal of the second electronic switch is connected to the output terminal of the NOT gate, a first terminal of the third electronic switch is connected to the output terminal of the NAND gate, second terminals of the first to third electronic switches are connected to the lighting circuit, third terminals of the first to third electronic switches are grounded.

10. The lamp control circuit as claimed in claim 9, wherein the lighting circuit comprises third to sixth resistors, the at least one LED of each LED group is connected in series, the third resistor is between the output terminal of the AC/DC voltage rectifier and a positive terminal of the first LED group, and a negative terminal of the first LED group is connected to the second terminal of the first electronic switch, the fourth resistor is connected between the output terminal of the AC/DC voltage rectifier and a positive terminal of the second LED group, and a negative terminal of the second LED group is connected to the second terminal of the second electronic switch, the fifth resistor is connected between the output terminal of the AC/DC voltage rectifier and a positive terminal of the third LED group, and a negative terminal of the third LED group is connected to the second terminal of the third electronic switch, the sixth resistor is connected between the output terminal of the AC/DC voltage rectifier and a positive terminal of the fourth LED group, and a negative terminal of the fourth LED group is grounded.

11. The lamp control circuit as claimed in claim 10, wherein the first to third electronic switches are n-channel field effect transistors, the first to the third terminals of the first to third electronic switches are gates, drains, and sources of the n-channel field effect transistors.

* * * * *